United States Patent [19]

Ogasahara

[11] Patent Number: 4,911,180

[45] Date of Patent: Mar. 27, 1990

[54] DISPOSABLE ASHTRAY

[76] Inventor: Shosuke Ogasahara, 3-9-3, Uozaki Nakamachi Higashinada-Ku, Kobe-Shi, Hyogo-Ken, 658, Japan

[21] Appl. No.: 199,602

[22] Filed: May 27, 1988

[30] Foreign Application Priority Data

| | | | |
|---|---|---|---|
| May 27, 1987 | [JP] | Japan | 62-80284[U] |
| Jul. 25, 1987 | [JP] | Japan | 62-114177[U] |
| Oct. 27, 1987 | [JP] | Japan | 62-163936[U] |
| Jan. 16, 1988 | [JP] | Japan | 63-3994[U] |

[51] Int. Cl.[4] ..... A24F 19/00; A24F 19/14; A24F 19/02

[52] U.S. Cl. ..... 131/231; 131/238; 131/240.1; 131/241; 131/242; 131/235.1

[58] Field of Search ..... 131/231, 235.1, 238, 131/240.1, 241

[56] References Cited

FOREIGN PATENT DOCUMENTS

| | | | |
|---|---|---|---|
| 0321276 | 9/1934 | Italy | 131/231 |
| 48-98971 | 3/1972 | Japan . | |
| 60-164898 | 11/1985 | Japan . | |

*Primary Examiner*—V. Millin

*Attorney, Agent, or Firm*—Price, Gess & Ubell

[57] ABSTRACT

The present invention is concerned with a disposable ashtray which can be disposed of simply and quickly without touching cigarette butts, ashes and the like in a hermetically sealed state without having any fear of fire. It is composed of an ash receiving saucer made of an incombustible leaf sheet consisting of a concave section for collecting cigarette butts and the like with a flange section around the circumference. It is designed to seal the ash receiving saucer by bonding each half of the flange section or by bonding the flange section to a shield cover. The disposable ashtray disclosed herein may also be provided for containing a plurality of the ash receiving saucers piled up in an ashtray holder.

13 Claims, 6 Drawing Sheets

DISPOSABLE ASHTRAY

BACKGROUND OF THE INVENTION

The present invention relates to a disposable ashtray designed to dispose of cigarette butts, ashes and the like contained therein by changing it into a sealed state so that there is no cause of fire. The disposal can be made simply and quickly without touching the ashes, cigarette butts and the like.

The present invention further relates to a disposable ashtray composed of a plurality of ash receiving saucers, and when the ash receiving saucer stacked at the top is disposed of as described above, a new ash receiving saucer is exposed instantly from underneath for an immediate use, by which the labor for replacing an ashtray with a cleaned one can be saved. It is convenient for use and timesaving as well.

As is well known, the conventional ashtrays have been used for temporarily putting a cigarette thereon while smoking and also for containing cigarette butts, ashes and the like therein, and most of them are made of such materials as metal, glass and ceramics. Generally, ashes and cigarette butts are thrown away into empty cans or trash cans and, thereafter, water is sprinkled for fire prevention. It is also customary to clean the used ashtrays by washing them for their next use.

Accordingly, the conventional ashtrays had inconveniences since ashes and cigarette butts needed to be completely extinguished for fire prevention when they were disposed of, and moreover, it was time and labor consuming for cleaning ashtrays for the next use. Especially, at such places as hotels, restaurants and offices where a great number of ashtrays are used, it is really a considerable workload for those who take care of the washing and the disposal of ashes, cigarette butts and the like. In addition, the cleaning work is disliked by workers since ashtrays are dirtied by ashes and so forth. Hence, some improvements are desired.

In order to solve such problems, Japanese Utility Model Laid-Open No. Sho 60-164898 discloses an ashtray-cover made of an aluminum foil which is placed on the surface of an ashtray. According to this prior art, the ashtray itself is prevented from dirt by eliminating direct contact with smoked cigarettes. After use, the ashtray cover is wadded up with cigarette butts, ashes and the like contained therein, and is disposed. However, it is difficult to make the inside of the cover in a state of complete sealing even when the cover is wadded up into a ball, and when the wadded ashtray cover is thrown away into a trash can, it invites an inflow of air into the cover and can enkindle the cigarette butts resulting in a cause of fire. Moreover, it is quite troublesome to transform the ashtray cover to fit it along concave section of the ashtray since the cover is formed in a plane shape originally.

As an another attempt to solve these problems, Japanese Patent Laid-Open No. Sho 48-98971 discloses an ash receiving saucer made of an aluminum foil piled up for use. However, this prior art fails in making clear reference to a practical approach to extinguish cigarette butts surely and automatically either.

SUMMARY OF THE INVENTION

The first object of the present invention is to provide a disposable ashtray which is disposable simply and quickly in a completely sealed state without any fear of fire after containing cigarette butts, ashes and the like therein without touching them at all. In order to accomplish this object, an ash receiving saucer formed by an incombustible leaf sheet is used as a disposable ashtray which consists of a concave section for containing cigarette butts, ashes and the like therein and a flange section around the circumference. When the ash receiving saucer is folded in half, the half portion of the flange section sticks to another half thereby making the inside into a completely sealed state, and as a result, the fire of cigarette butts therein is extinguish surely and automatically. As a practical means for sealing, a self-bonding type adhesive layer is provided on the surface of the flange section. As an another practical means, an adhesive layer is provided on the surface of a flange section and a released tape is covered thereon.

In order to accomplish the same object, another disposable ashtray is designed in combination with an ash receiving saucer formed of an incombustible leaf sheet which consists of a concave section for containing cigarette butts, ashes and the like therein and a flange section around the circumference, and a shield cover to seal the ash receiving saucer. After use, by bonding the shield cover to the ash receiving saucer, the fire of the cigarette butts collected in the ash receiving saucer is extinguished automatically and completely. As a practical means, a shield cover is provided to accomplish the object. The sheet cover is equipped with adhesive layer on the under surface, and the adhesive layer is covered with a released sheet. On removing the released sheet, the shield cover bonds to a flange section of the ash receiving saucer thereby creating a hermetical seal. As an another practical means, a shield sheet cover is provided to accomplish the object. The shield cover is rolled in a sheet holder, and an adhesive layer is provided all over the surface. The shield cover is drawn out of the sheet holder and bonded to a flange section of an ash receiving saucer thereby making the inside in a state of being hermetically sealed. The shield cover is then cut into proper lengths.

The second object of the present invention is to provide a disposable ashtray which is comprised of a plurality of ash receiving saucers. When the ash receiving saucer placed at the top is disposed of, a new ash receiving saucer is exposed instantly from the underneath for immediate use thereby eliminating the labor for replacing an ashtray with new one. It is really convenient for use. In order to accomplish the object, an ash receiving saucer is designed as described above further providing a taper to the side wall of the concave section, and a plurality of the ash receiving saucers are piled up in an ashtray holder.

Further objects and features of the present invention will be better understood by reference to the following description, and to the drawings forming a part thereof.

DETAILED DESCRIPTION OF THE INVENTION

Figure 1:
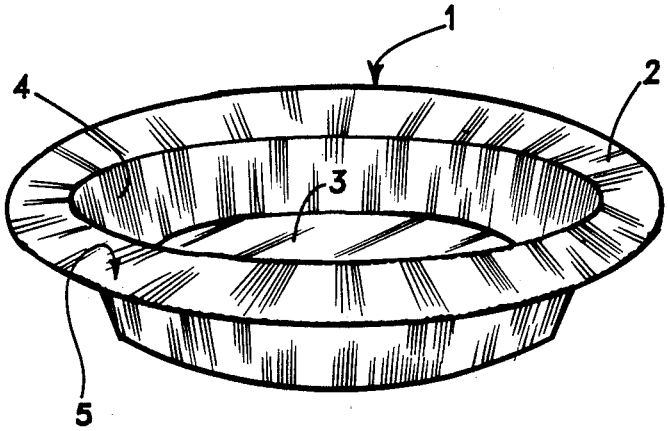
FIG. 1 is a perspective view of the ash receiving saucer in the first embodiment of the present invention.
Figure 2:
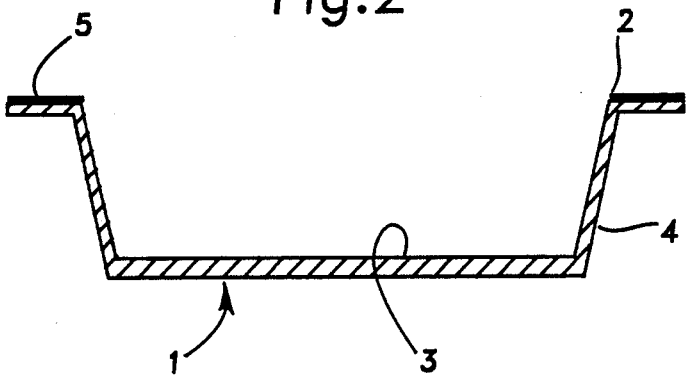
FIG. 2 is a sectional view of FIG. 1.
Figure 2A:
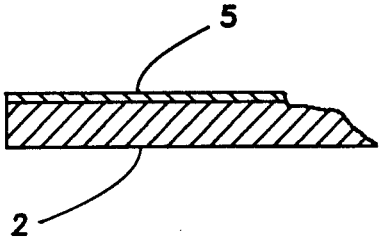

The embodiments of the present invention will be described below with reference to the drawings. FIGS. 1 through 6 illustrate the first embodiment of the present invention. FIGS. 1 and 2 show an ash receiving saucer 1 which can be used as a disposable ashtray itself. The ash receiving saucer 1 is composed of an aluminum foil that is pressed to form a flange section 2 around the circumference with concave section 3 provided in the center for containing ashes, cigarette butts and the like therein. An aluminum foil of 10–30 μm thickness is used for the ash receiving saucer, however, thicker or thinner aluminum foil may be used. Another kind of incombustible leaf sheet such as stainless steel foil and incombustible paper may be used instead of the aluminum foil. The concave section 3 is formed into a round saucer shape, and the circumferential wall 4 is tapered at the lower portion. The flange section 2 is also formed into a round flange. At the time when the ash receiving saucer 1 is pressed, a great number of wrinkles are uniformly formed at the circumferential wall 4 of the concave section 3 and the flange section 2. The ash receiving saucer 1 can be shaped in any form such as square, rectangle and so forth. On all the surface of the flange section 2, a self-bonding type of adhesive layer 5 is provided. The adhesives used for the self-bonding type of adhesive layer 5 shows stickiness when a sticky surface is bond together. However, the sticky surface itself of the adhesive does not show any stickiness o other substances. Such adhesive is known well as a water-soluble emulsion type adhesive and is already marketed under various brand names. For making the self-bonding type adhesive layer 5, the said adhesive can be either coated or sprayed on the flange section 2 and shows rapid self-bonding adhesion in a very short period of time after coating or spraying is done as it possesses quick drying characteristics. Or, it may also be possible to preparatorily form the self-bonding type adhesive layer 5 on one side of the surface of an aluminum foil to be used as a material. In this case, an aluminum foil with the self-bonding type adhesive layer 5 provided on one side of its entire surface is formed into a predetermined shape of an ash receiving saucer 1 by press working. In other words, the self-bonding type adhesive layer 5 is formed on the entire upper surface of the ash receiving saucer 1. Even in such a case, the self-bonding type adhesive layer 5 does not interfere with press working as it possesses non-stick characteristics against other substances, and thereby smooth work can be carried out as it does not stick to hands either.

Figure 3:
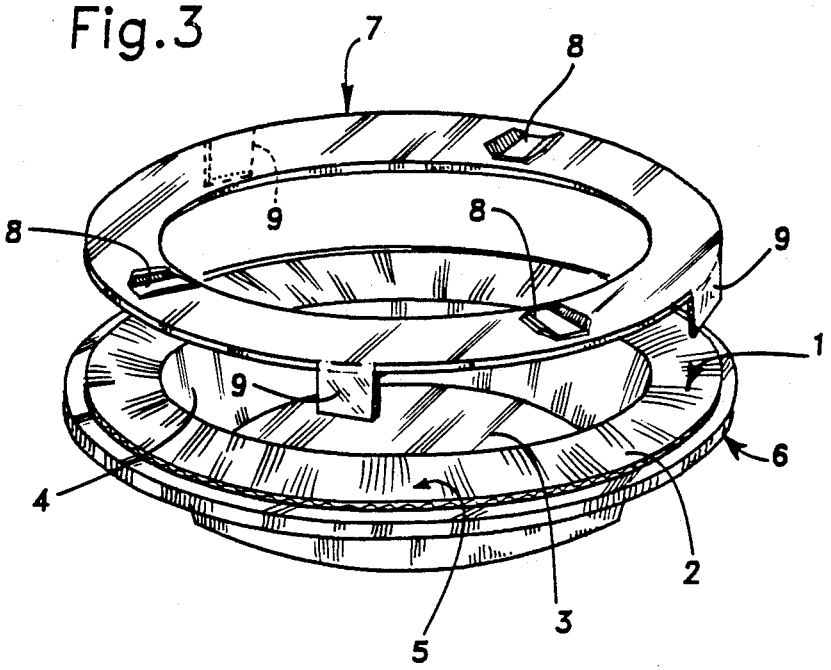
FIG. 3 is a perspective view of a disposable ashtray consisted of a plurality of ash receiving saucers stacked in an ashtray holder.
Figure 4:
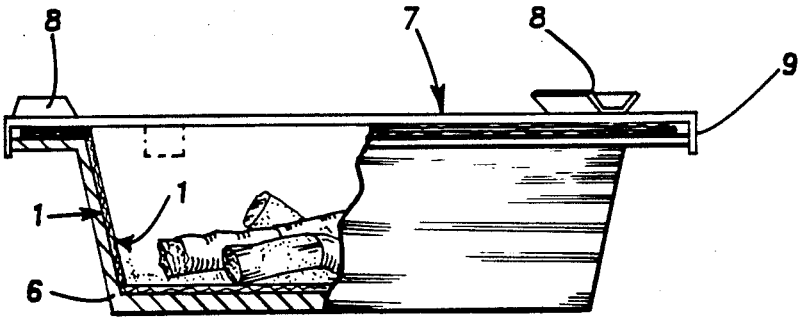
FIG. 4 is a partially cutaway view of FIG. 3.

A plurality of the ash receiving saucers 1 described above are piled up and contained in an ashtray holder 6 as shown in FIGS. 3 and 4. For the ashtray holder 6, any kind of ashtray made of such materials as metal, plastic, ceramics and glass being sold on the market can be used. If required, special ashtray holders that are on the market can be used. If required, special ashtray holders may be prepared which match the shape and size of the above ash receiving saucer 1. It is, however, necessary to form the ashtray holder 6 so as to permit it to contain a plurality of the ash receiving saucers 1 in a stacked-up arrangement so as to permit them to be freely dispensed. Each of the ash receiving saucer 1 in the stack is provided with a self-bonding type adhesive layer 5 on the upper flange section 2, however, a non-adhesion condition can be maintained with an ash receiving saucer placed underneath. In addition, the ash receiving saucer 1 placed at the top of stacked layer can be easily pulled out of the next saucer as the circumferential wall 4 of the saucer 1 is tapered at the lower part.

On the upper surface of the ash receiving saucer 1, a cigarette holder ring 7 is disposed. The cigarette holder ring 7 consists of a plurality of cigarette supports 8 on the upper surface, and a plurality of leg sections 9 which are extruded underneath to regulate the position of the ring 7. It is advisable to use a metal plate such as a stainless steel plate to form the cigarette holder ring 7 by press working. Hence, it protects the adhesive layer 5 from dirt and can be kept always clean and neat.

Figure 5:
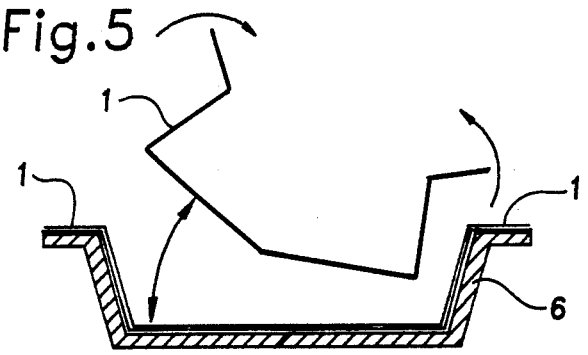
FIG. 5 is a section view showing how the disposable ashtray in FIG. 4 is used.
Figure 5A:
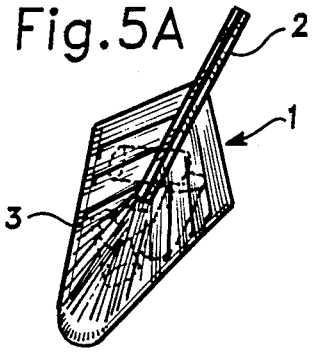

The disposable ashtray receiving saucer 1 can be placed at the top of the stacked up saucers and then the individual saucer member can be disposed of after use. The used saucer can be easily pulled out after removing the cigarette holder ring 7. The ash receiving saucer 1 underneath the used saucer is then instantly exposed for the next use. In other words, the next saucer is ready for use merely by pulling out the saucer 1 at the top, and consequently, the time and labor for exchanging ashtrays are saved. Secondly, the flange section 2 of the used saucer 1 is folded in half as shown in FIG. 5 so that the half portion of the flange bonds to the other half and seals the flange section 2 by effect of the self-bonding type adhesive layer 5. Accordingly, the fire of cigarette butts is automatically and completely extinguished as the flow of air into the ash receiving saucer 1 is limited. There is no fear of fire even if the ash receiving saucer 1 is thrown into a trash can or garbage can.

Figure 6:
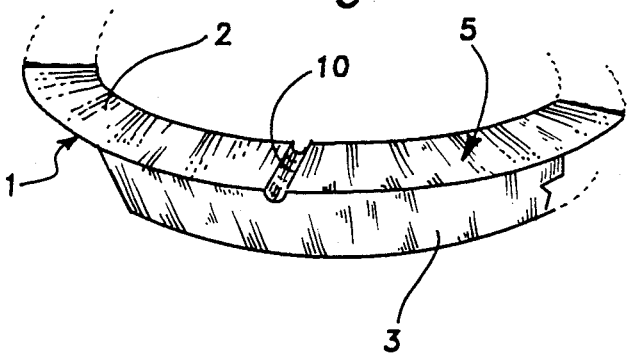
FIG. 6 is a perspective view showing the main part of an ash receiving saucer, and a part of which is transformed from the first embodiment.

The ash receiving saucer 1 as shown in FIG. 6 provides a plurality of folding grooves 10 on the flange section 2 by press working. By providing two of the grooves on the same straight line, the work for folding and laying a half of the flange section on the other half can be done quickly and accurately.

Figure 7:
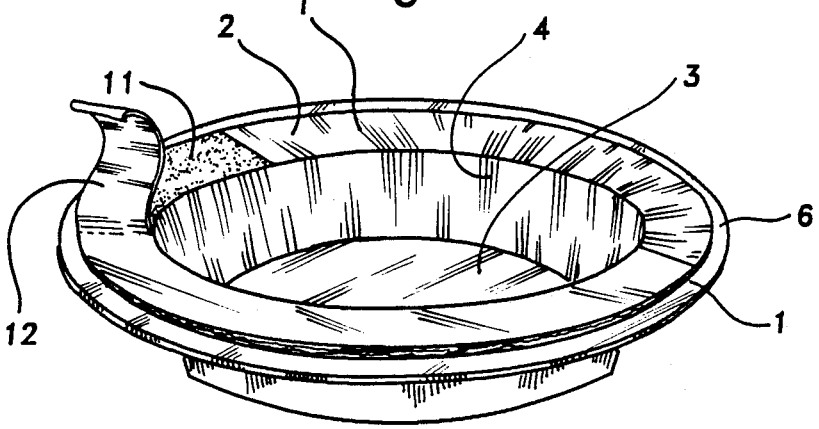
FIG. 7 is a perspective view of the disposable ashtray in the second embodiment of the present invention.

FIG. 7 illustrates the second embodiment of the present invention. The ash receiving saucer 1 in the second embodiment provides a flange section 2 and on the half surface of which adhesive layer 11 is formed with a released tape 12 covered thereon, which is a feature of this invention. The other structures are the same as the one disclosed in the first embodiment and the use is basically the same as that of the first embodiment (refer to FIG. 4). For the adhesive layer 11, the use of the pressure sensitive adhesives being marketed is preferable, however, an ordinary non-dry adhesives may also be used. The released tape 12 is temporarily stuck to cover the adhesive layer 11, for example, silicon processed paper may be used for this purpose. In stead of the adhesive layer 11 and the released tape described above, the so-called double coated adhesive tape being marketed may also be used as it possesses the two functions. Thus, after the ash receiving saucer 1 in this embodiment is used, the released tape is first peeled off and the adhesive layer 11 is exposed. Then, the flange section 2 is folded into half and laid on top of the other half so that the flange section 2 is sealed by the effect of the adhesive layer 11. The ash receiving saucer 1 is now completely sealed in a manner shown in FIG. 5.

In FIG. 7, the adhesive layer 11 is formed only on a half surface of the flange section 2, however, the layer 11 may be formed on more than a half portion of the flange surface. For instance, such adhesive layer 11 may be formed all over the surface of the flange section 2 though all the surface of the flange section 2 has to be covered by the released tape 12.

Figure 8:
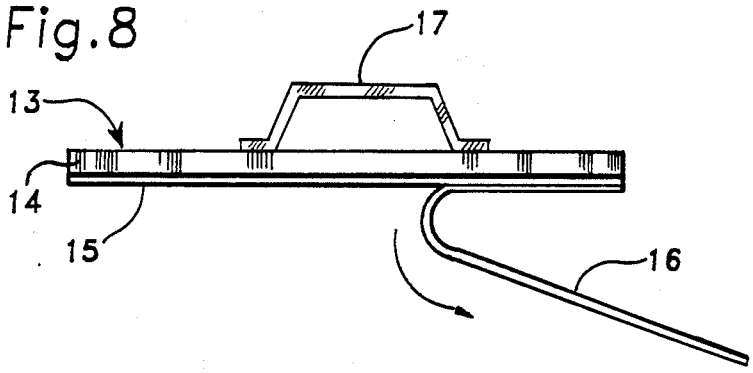
FIG. 8 is a side view of the shield cover in the third embodiment of the present invention.
Figure 9:
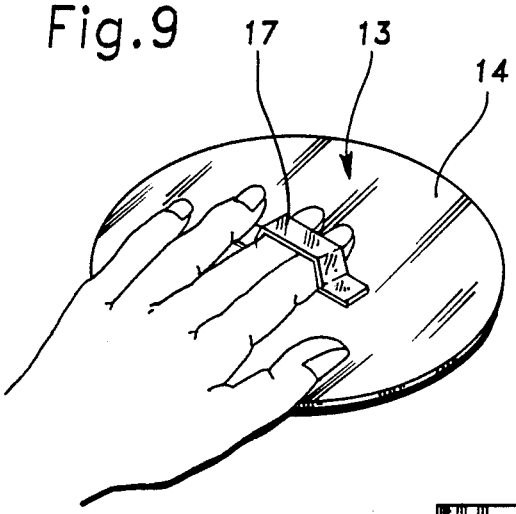
FIG. 9 is a perspective view showing how the shield cover illustrated in FIG. 8 is used.
Figure 10:
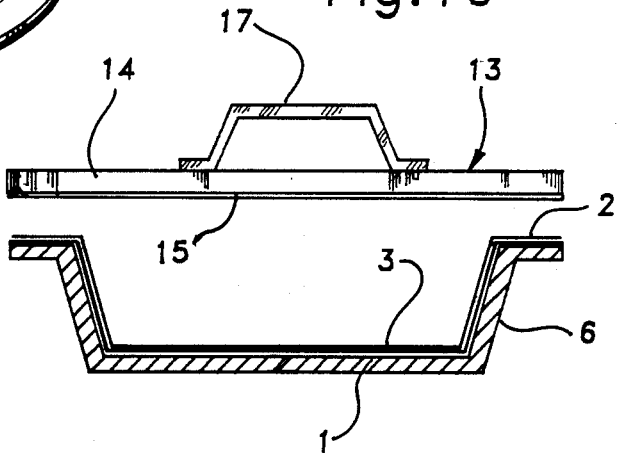
FIG. 10 is a sectional view illustrating a shield cover, a plurality of ash receiving saucers and an ashtray holder.
Figure 11:
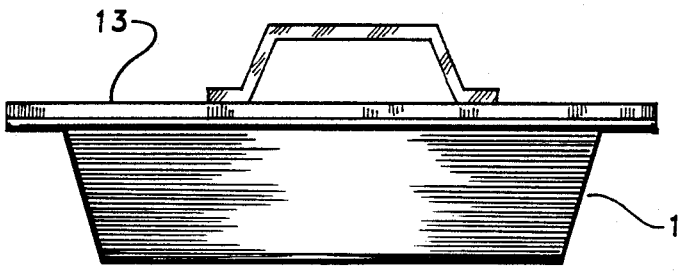
FIG. 11 is a side view showing a sealed state when a shield cover is bonded to the upper layer of an ash receiving saucer.

FIGS. 8 through 11 illustrate the third embodiment of the present invention. A disposable ashtray in this embodiment is composed of an ash receiving saucer 1 formed by an incombustible leaf sheet having a concave section for collecting cigarette butts, ashes and the like therein with a flange section 2 provided on the circumference, and a shield cover 13 to which the flange section 2 of the ash receiving saucer 1 is bonded and is capable of sealing the ash receiving saucer 1. The ash receiving saucer 1 is formed in the same manner as shown in FIG. 1 excepting that the flange section 2 is not formed by an adhesive layer. The shield cover 13 is made in a round shape and its plane configuration is almost the same as the outside configuration of the flange section 2 as shown in FIGS. 8 and 9. The shield cover 13 is made of a cardboard which has flexibility and proper strength, and on the under surface of the cardboard material 14, adhesive is provided to form an adhesive layer 15 which covered by a released sheet 16 thereon. Besides, finger-insert section 17 is prepared on the upper surface of the shield cover 13 for convenience' sake in handling. A plurality of ash receiving saucers 1 are stacked in an ashtray holder 6 as shown in FIG. 10. After use, disposal of the ash receiving saucer placed at the top will be done as follows. First, peel off the released sheet 16 to expose the adhesive layer 15 while holding the shield cover 13 as shown in FIG. 9. Then, press the shield cover 13 against the ash receiving saucer 1 from vertically above the saucer as in FIG. 10, and bond the shield cover 13 to the flange section 2 of the ash receiving saucer 1 by making use of the adhesive layer 15. Thereafter, press down both ends of the cover with thumb, little finger and ring finger while lifting up slightly the shield cover 13, then the ash receiving saucer 1 is lifted up slightly followed by the swell of the shield cover 13 by its elastic deformation as it possesses flexibility and proper strength, with the result that separation of the saucer at the top and the ones underneath is easily done. Once the pressure against both ends of the shield cover 13 is loosen, the ash receiving saucer 1 that is piled up underneath the saucer at the top is pressed downward by the elastic restoring force of the shield cover 13 and settle in the ashtray holder 6. Finally, only the ash receiving saucer 1 at the top is removed upward by the shield cover 13, and it forms a sealed container comprised of the ash receiving saucer 1 and a shield cover 13 as shown in FIG. 11. The shield container is then disposed of with ashes, cigarette butts and the like contained therein. The shield cover 13 made of an incombustible or flame-resisting material is preferable; for example, a cover made of a synthetic resin material is more preferable. Further, if self-bonding type adhesive layers are formed on the under surface of the shield cover 13 and also on the upper surface of the flange section 2, the released sheet can be eliminated.

Figure 12:
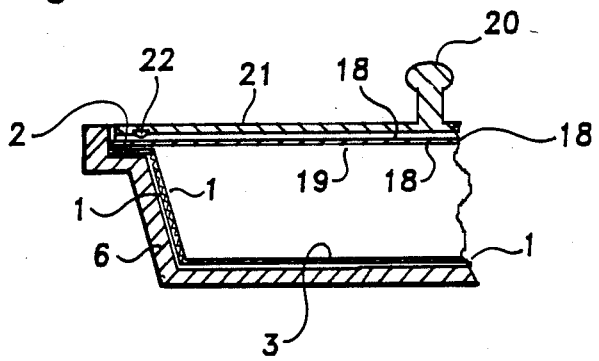
FIG. 12 is a sectional view illustrating the main part of a disposable ashtray which is equipped with the shield cover in the fourth embodiment of the present invention.
Figure 13A:
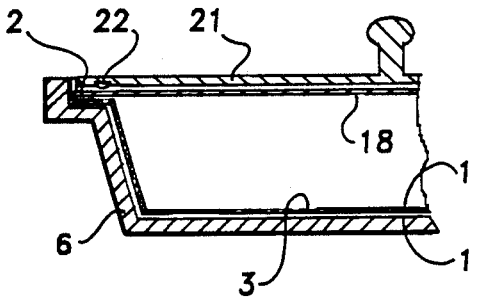
FIG. 13 is a sectional view showing how the disposable ashtray illustrated in FIG. 12 is used.
Figure 13B:
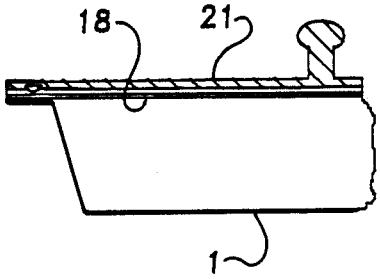
Figure 14:
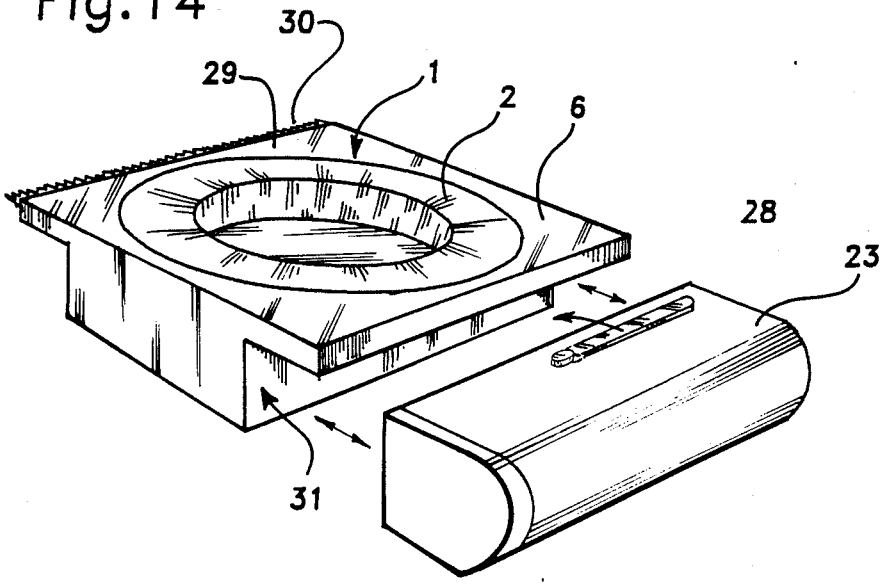
FIG. 14 is a perspective view of a disposable ashtray provided with a roll-wound shield cover in a sheet holder in the fifth embodiment of the present invention.
Figure 15:
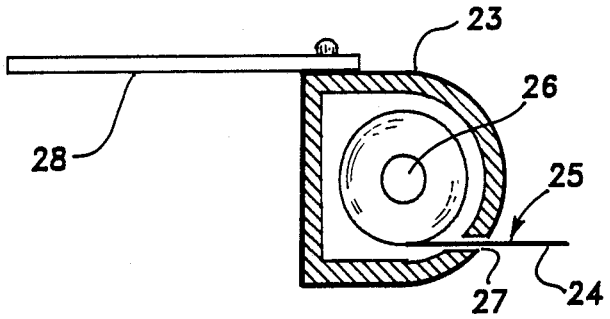
FIG. 15 is a sectional view illustrating the sheet holder and the shield cover in FIG. 14.

FIGS. 12 and 13 illustrate the fourth embodiment of the present invention. The disposable ashtray in this embodiment is composed of an ash receiving saucer 1 which is the same as the one shown in FIG. 1, and a leaf shield cover 18 to which the flange section 2 of the ash receiving saucer is bonded for sealing the ash receiving saucer 1.

A plurality of the ash receiving saucers 1 are piled up and contained in the ashtray holder 6. On the other hand, a plurality of the shield covers 18 formed by such metal foils as aluminum foil are piled up in a container 19 which serves to extinguish fire. The container 19 is covered by a cover board 21 equipped with a knob 20. Self-bonding type adhesive layers (not shown) are formed both on the upper surface of flange section 2 of the ash receiving saucer 1 and also on the under surface of the shield cover 18. An adhesive 22 formed in a ring shape is laid under the surface of the cover board 21, and the adhesive 22 is prepared to temporarily bond the top of the shield cover 18 contained in the container 19 to the cover board 21.

The disposable ashtray in this embodiment is used by removing the container 19 from the ashtray holder 6, and the disposal of the ash receiving saucer 1 on the top is done in the following order. First, lift up the cover board 21 after pressing it on the container 19, then the shield cover 18 is taken out of the container 19 in a state that the cover 18 is temporarily bonded to the board 21. After that, press the cover board 21 against the ash receiving saucer 1 from just vertically above as shown in FIG. 13. Then, the shield cover 18 and the flange section 2 of the ash receiving saucer 1 are bond together firmly by the effect of the self-bonding type adhesive layer. Thereafter, when the cover board 21 is lifted up as shown by a phantom line in FIG. 13, the ash receiving saucer 1 at the top is removed together with the shield cover 18 from the ashtray holder 6. Thus, the sealed container composed of an ash receiving saucer 1 and a shield cover 18 is removed from the ashtray holder 6, and it is further removed from the cardboard 21 for disposal. Thereafter, the cardboard 21 covers the container 19 again and is contained therein ready for temporary bonding to the shield cover 18.

FIGS. 14 through 19 illustrate the fifth embodiment of the present invention. The disposable ashtray in this embodiment is composed of a shield cover sheet 25 with adhesive layer 24 provided all over the surface and rolled in a sheet holder 23. The shield cover sheet 25 is drawn out from the sheet holder 23 and bonded to the flange section 2 of the ash receiving saucer 1 for sealing the saucer 1. It is also designed to cut the shield cover sheet 25 properly. For the shield cover sheet 25, it is preferable to use the aluminum foil on one side of which an adhesive layer 24 is formed and the other side is treated for separation by silicon and the like. The sheet holder 23 is equipped with a freely rotatable winding core 26 inside and holds the rolled cover sheet 25. The holder 23 is also equipped with an outlet 27 to draw out the rolled shield cover 25. The rolled shield cover 25 can be taken in and out from the side of the sheet holder 23, and the holder 23 has a movable lever 28 on the upper surface.

A plurality of ash receiving saucers 1 are piled up and contained in the concave section of an ashtray holder 6. The ashtray holder 6 is equipped with square flange section 29, and at one end of which a saw blade 30 is disposed. There is a space at the opposite lower end of the saw blade 30 for containing the sheet holder 23. The sheet holder 23 contained in the space is designed to cling to the ashtray holder 6 for free attachment and detachment by making use of a permanent magnet.

Figure 16:
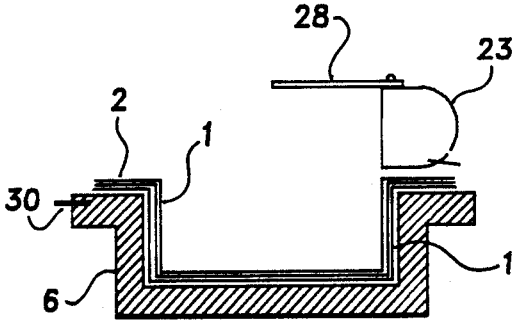
FIGS. 16, 17 and 18 are sectional views showing how the sheet holder and shield cover in FIG. 15 are used.
Figure 17:
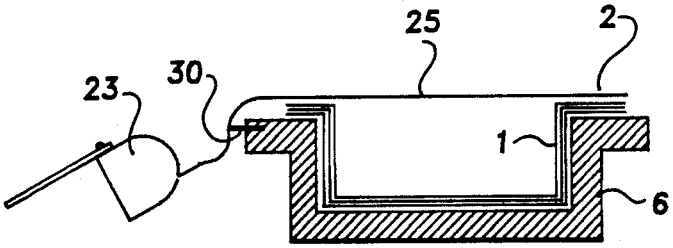
Figure 18:
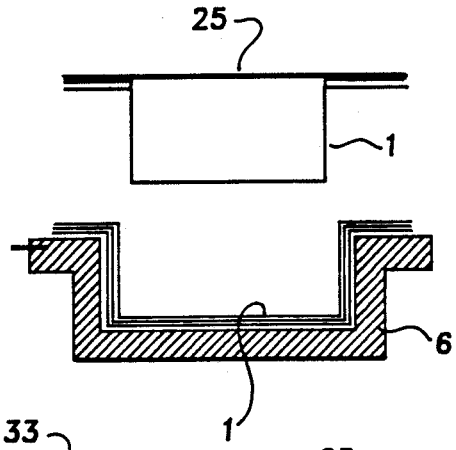

The use of the disposable ashtray will be described below. The disposal of the ash receiving saucer 1 at the top is done in the following order. Firstly, detach the sheet holder 23 from the ashtray holder 6, and bond the front end of the shield cover 25 which can be seen from the outlet 27 of the sheet holder 23 to the end of flange section 2 of the ash receiving saucer as shown in FIG. 16. Then, slowly pull the sheet holder 23 to the direction of left hand side of the figure, and by pulling out the shield cover 25 from the sheet holder 23, bond the shield cover 25 to the entire surface of the flange section 2. Thereafter, cut the shield cover 25 to a predetermined size using the saw blade 30 as shown in FIG. 17. Thus, a sealed object which contains ashes, cigarette butts and the like is obtained as shown in FIG. 18. The sealed object, i.e. an ash receiving saucer 1 sealed by a shield cover 25, is now ready for disposal by removing it from the ashtray holder 6. It can be thrown into an empty can or garbage can without having any fear of fire. At the same time, a new ash receiving saucer 1 is exposed ready for use.

Figure 19:
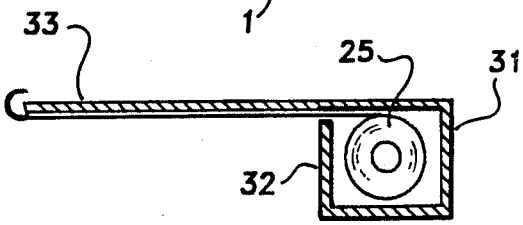
FIG. 19 is a sectional view showing an example of a transformed sheet holder.

In place of the sheet holder 23, any other form of sheet holder may be useable, for instance, the sheet holder 31 as shown in FIG. 19 is also applicable. The sheet holder 31 is equipped with a holding board 33 extended from a holder 32, and it features a bonding of a shield cover 25 to the flange section 2 of an ash receiving saucer 1 by the holding board 33. The sheet holder shown in FIG. 19 is equipped also with perforations at a predetermined space so that the sheet cover 25 can be cut by making use of the perforations.

While the present invention has been described in connection with certain specific embodiments, it is to be understood that it is not to be limited to those embodiments. On the contrary, it is intended to cover alternatives and modifications falling within the spirit and scope of the invention as set forth in the appended claims.

What is claimed is:

1. A disposable ashtray composed of an ash receiving saucer, comprising:
   - means for providing a concave section for collecting cigarette butts, ashes and the like;
   - means for providing a flange section around the circumference of the concave section; and
   - means for bonding a half portion of the flange section to the other half portion when the ash receiving saucer is folded in half or disposal.

2. The disposable ashtray of claim 1, wherein the incombustible leaf sheet is composed of metal foil.

3. The disposable ashtray of claim 2, wherein the metal foil is an aluminum foil.

4. The disposable ashtray of claim 2, wherein the ash receiving saucer is composed of a metal foil by press working.

5. The disposable ashtray of claim 1; wherein the surface of the flange section is equipped with a self-bonding type adhesive layer.

6. The disposable ashtray of claim 1, wherein an adhesive layer is provided on the surface of the flange section with a released tape covered thereon.

7. The disposable ashtray of claims 1, wherein a pair of grooves are formed on the flange section for folding the flange section into half.

8. A disposable ashtray composed of an ash receiving saucer and a shield cover, comprising:
   - an ash receiving saucer formed of an incombustible leaf sheet which consists of a concave section for collecting cigarette butts, ashes and the like and a flange section around the circumference;
   - a shield cover which seals the ash receiving saucer by bonding to the flange section of the ash receiving saucer; and
   - means for bonding the shield cover to the flange section of the ash receiving saucer.

9. The disposable ashtray of claim 8, wherein the shield cover is equipped with an adhesive layer on the under surface and is covered with a released sheet thereon.

10. The disposable ashtray of claim 8, wherein the shield cover and the flange section of the ash receiving saucer are equipped with a self-bonding type adhesive layer on the surface of each.

11. The disposable ashtray of claim 8, comprising:
   - a shield cover made of a sheet with adhesive layer formed on one side and rolled in a sheet holder;
   - means for cutting the shield cover properly.

12. A disposable ashtray equipped with an ashtray holder which contains a plurality of ash receiving saucers, comprising:
   - an ash receiving saucer formed of an incombustible leaf sheet which includes a concave section tapered for collecting cigarette butts, ashes and the like and a flange section around the
   - an ashtray holder containing a plurality of ash receiving saucers which are piled up therein, and
   - means for sealing the ash receiving saucer, including a flange section on each of the saucers and a half portion of each flange section that can be bonded together when the ash receiving saucer is folded in half.

13. A disposable ashtray equipped with an ashtray holdr which contains a plurality of ash receiving saucers, comprising:
   - an ash receiving saucer formed of an incombustible leaf sheet which includes a concave section tapered for collecting cigarette butts, ashes and the like and a flange section around the circumference of the concave section;
   - an ashtray holder containing a plurality of ash receiving saucers which are piled up therein, and
   - means for sealing each ash receiving saucer, including a shield cover which bonds to and completely seals the flange section of the ash receiving saucer.

* * * * *